US007047648B1

(12) United States Patent
LeBel et al.

(10) Patent No.: US 7,047,648 B1
(45) Date of Patent: May 23, 2006

(54) SPOON WITH EXTENDABLE STRAW

(76) Inventors: John P. LeBel, 1530 Armstrong Ave., No. 123, Novato, CA (US) 94945; Rachel LeBel, 1530 Armstrong Ave., No. 123, Novato, CA (US) 94945

( * ) Notice: Subject to any disclaimer, the term of this patent is extended or adjusted under 35 U.S.C. 154(b) by 0 days.

(21) Appl. No.: 10/940,512

(22) Filed: Sep. 13, 2004

(51) Int. Cl.
*A47J 43/28* (2006.01)

(52) U.S. Cl. ..... 30/141; 30/324; D7/300.2; D7/643

(58) Field of Classification Search ..... 30/141, 30/324, 123, 326, 327, 142; D7/300.2, 643
See application file for complete search history.

(56) References Cited

U.S. PATENT DOCUMENTS

| | | | | | |
|---|---|---|---|---|---|
| 285,054 | A | * | 9/1883 | Moffitt | 30/141 |
| 674,446 | A | | 5/1901 | Marx | |
| 1,490,785 | A | * | 4/1924 | Purnell | 30/141 |
| 1,606,038 | A | * | 11/1926 | Norman | 30/141 |
| 1,606,039 | A | | 11/1926 | Norman | |
| 1,666,106 | A | | 4/1928 | Norman | |
| 1,857,712 | A | * | 5/1932 | Martini, Jr. | 222/357 |
| 2,859,515 | A | * | 11/1958 | Kinman | 30/141 |
| 3,038,256 | A | * | 6/1962 | Mayer | 30/141 |
| D259,533 | S | * | 6/1981 | Frodsham | D7/300.2 |
| D290,328 | S | | 6/1987 | Imotani | |
| D316,503 | S | * | 4/1991 | O'Grady | D7/643 |
| 5,038,476 | A | * | 8/1991 | McCrea | 30/141 |
| D330,481 | S | | 10/1992 | Green | |
| D370,587 | S | | 6/1996 | Lynch | |
| 5,727,321 | A | * | 3/1998 | Lewis | 30/141 |
| 5,946,807 | A | | 9/1999 | Crane | |
| D440,810 | S | | 4/2001 | Olson | |
| D458,809 | S | * | 6/2002 | Richardson et al. | D7/643 |
| 6,463,662 | B1 | | 10/2002 | Coscia | |
| 2004/0237311 | A1 | * | 12/2004 | Brown et al. | 30/141 |

FOREIGN PATENT DOCUMENTS

| | | | |
|---|---|---|---|
| DE | 38 02 694 | A1 * | 8/1989 |
| GB | 2 083 341 | A * | 3/1982 |

* cited by examiner

*Primary Examiner*—Timothy V. Eley
(74) *Attorney, Agent, or Firm*—Gerald R. Prettyman, Jr.; Charlotte M. Rodeen-Dickert

(57) ABSTRACT

An eating utensil for consumption of liquid, semi-liquid, semi-solid, and solid foodstuffs through the use of a combination spoon and straw.

8 Claims, 11 Drawing Sheets

SPOON WITH EXTENDABLE STRAW

FIELD OF THE INVENTION

The present invention relates generally to eating utensils, and specifically to a utensil having functions relating both to a spoon and a straw.

Certain foods, such as ice cream, crushed ice beverages, and the like, are most suitably consumed with a utensil that combines the functions of a spoon, for transporting solid portions of the food product, and of a straw, for consuming the melt, or liquid portion of the food. Previous inventions integrate these functions by incorporating various combinations of a spoon and a straw. These inventions, however, suffer various disadvantages resulting from this integration. The present device overcomes these disadvantages by permitting the user to adopt commercially available straws properly suited to the particular container and the food being consumed.

BACKGROUND

U.S. Pat. No. 674,446 to Marx is called a "Spoon." U.S. Pat. No. DES 259,533 to Frodsham is called a "Spoon straw." These references illustrate a spoon/straw combination having a fluid intake orifice of a straw interposed within a bowl of the spoon section. A disadvantage of such a design is the inability to separate spooning and aspirating functions. Thus, fluid may enter the straw section while spooning, and inadvertently pass through the straw, exiting the aspiration port of the straw, resulting in spillage of the fluid. Furthermore, neither the Marx nor Frodsham structures permit aspiration of fluid unless the fluid is capable of being scooped into the bowl of the spoon section.

U.S. Pat. No. 1,606,039 called a "Combined Straw and Spoon Construction" and U.S. Pat. No. 1,666,106 called a "Spoon," both to Norman are spoons with a holder mechanism for a straw. The Norman '039 and '106 references suffer from the disadvantage that a straw with a length longer than the length of the spoon is necessary for use of this feature. Also, as the holding mechanism of each reference is a clip mechanism, the straw is not firmly secured by the device.

U.S. Pat. No. 5,727,321 to Lewis is called a "Utensil with Both Spoon and Straw Functions." The Lewis '321 reference is a straw with a concave attachment serving as a spoon on the upper side, and a tubular extension terminating downwards on the inferior side of the concavity as the straw extension. The Lewis '321 reference suffers from the disadvantage that although the spoon is broad, it is not deep. It cannot hold an amount similar to a regular spoon, yet the spoon is wide and prevents the straw from reaching the base of narrow containers. Also, as the spoon extension is detachable, the user risks the spoon slipping off, and burying itself into the food stuff.

U.S. Pat. No. 5,946,807 to Crane, et. al. is called a "Novelty Spoon." The Crane '807 reference is a two-piece straw with a spoon integrally attached above the intake orifice of the straw. A decorative novelty lies on the top of the upper portion of the straw. The intake orifice end of the straw lies flush with the curvature of the underside of the spoon. A disadvantage of such a design is the inability to separate spooning and aspirating functions. Thus, fluid will enter the straw section while spooning, and may pass through the straw, exiting the aspiration port of the straw, resulting in spillage of the fluid.

U.S. Pat. No. 6,463,662 to Coscia, et al. is called a "Spoon and Straw Combination Device." The Coscia '662 reference is a one-piece straw and spoon with the intake orifice of the straw facing upwards from a reservoir under the concavity of the spoon. The '662 reference suffers from the disadvantage that the fixed angle of the spoon and straw, in combination with the superior angle of the straw intake orifice and width of the spoon body prevent the straw from withdrawing fluids from the container bottom. This disadvantage occurs because the user cannot place the intake point of the straw against the bottom of container except to point the handle completely sideways, at which point the intake orifice is still at some angle upwards more than 90 degrees from the bottom of the container, and draws in air.

U.S. Pat. No. DES 290,328 to Imotani is called a "Straw with a bowl-like head." The '328 Imotani reference illustrates a spoon cavity attached to a straw member by means of two extension arms from the spoon cavity section. The straw intake orifice is situated above and proximate to the spoon cavity with no barrier to prevent fluid communication between the two operable sections. The device disclosed in the Imotani '328 reference provides fluid communication between a bowl of the spoon section and an intake orifice of the straw section. Thus, there is no separation of the spooning and aspirating functions. The device disclosed in the '328 Imotani reference has a further disadvantage that the straw intake orifice is necessarily elevated above the bottom of a comestible containing vessel by the height of the spoon cavity section. This prevents the straw intake orifice from effectively communicating with the bottom of the vessel, inhibiting the user of the device from drawing fluid from the bottom portion of the vessel.

U.S. Pat. No. DES 316,503 to O'Grady is called a "Combined Spoon and Straw Holder." The O'Grady '503 reference is a spoon with semi-circular clips on the handle for holding a separate straw. The concavity of the spoon faces upwards to the handle at an oblique angle, similar to a ladle. The O'Grady '503 reference suffers from the disadvantage that the straw may only extend only into the concavity of the spoon, and because of the spoon's width and height, the spoon is unable to withdraw fluids from the bottom of most containers.

U.S. Pat. No. DES 330,481 to Green is a called a "Spoon Straw." The Green '481 reference is a one-piece hollow handle spoon with the intake orifice end of the straw running under spoon, and the intake orifice of the straw facing the same angle as the superior face of the distal end of the spoon. The Green '481 reference suffers from two disadvantages. First, the intake orifice of the straw cannot face downward flat against any usual beverage or dessert container. (It may work in that configuration if held with the spoon facing downwards into a broad and long container, such as a 'boat' tray.) Next, the 'straw' is only as long as the handle, thus requiring the user to place the users mouth very close to the container, which is difficult to do with flexible ice cream boats and yet not place the user's face into the boat.

U.S. Pat. No. DES 370,587 to Lynch is called a "Spoon-Straw." The Lynch '587 reference is a hollow spoon with the handle serving as a straw to the user's mouth. The spoon is a dual shell body with four triangular holes in the outer shell. These holes serve as the mouth of the straw. The Lynch '587 reference suffers from a number of disadvantages. First, fluid may enter the straw section while spooning, and inadvertently pass through the straw, exiting the aspiration port of the straw, resulting in spillage of the fluid. Second, as the four holes are located circumferentially about the face of the spoon, the entrance holes cannot all simultaneously be at the bottom of the beverage container, so suction is lost when the fluid level reaches the higher of holes. Additionally, the width of the spoon prevents the straw from withdrawing fluids near the bottom of containers narrower than the width of the spoon.

U.S. Pat. No. DES 440,810 to Olson is called a "Combined Drink Straw with Integral Spoon." The Olsen '810 reference is a single piece of straight tubing terminating in a shovel-like spoon, The Olsen '810 reference is similar to the popular "Slurpee"® straw. The Olsen '810 reference suffers from several disadvantages: (1) if the straw is made of inflexible material, the straw opening cannot reach the bottom of containers narrower than the spoon; (2) if the straw is made of flexible material, the spoon cannot scoop firm semi-solid foods; and (3) if the straw is made of flexible material, the spoon cannot support the weight of semi-solid foods of other than much less than bite-size amounts.

U.S. Pat. No. DES 458,809 to Richardson, et al., is called a "Combination Spoon and Straw." The Richardson '809 reference is a spoon with a straw integrally formed under the handle. The intake orifice end of the straw follows the contour of the underside of the spoon and terminates in an oblique entry point. The aspiration end of the straw incorporates a flexible accordion-fold terminal end to allow both extending and bending of the straw. The Richardson '809 reference suffers from the disadvantages that (1) the width of the spoon prevents the intake orifice from reaching containers narrower than the width of the spoon; (2) the straw diameter is fixed at one-size, and the invention does not permit the use of other commercially available straws with the invention; and (3) the invention is limited to a single use because its length and the accordion-fold are difficult to clean.

SUMMARY

The present device permits the consumer of foods, such as ice cream, crushed ice beverages, and the like to consume the solid portion the food, with the spoon capacity of an inflexible spoon, and to reach and consume the liquid, i.e., melt portion of the food, and the semi-liquid portion, including such portions as 'trapped' in a semi-solid state, too stiff to flow, and yet too deep to recover with a spoon.

The present device allows the user to insert and withdraw for use, a commercially available straw, either at full length, or where the user has cut the straw to a particular length, with the handle of the device serving in either case to hold the straw for the user. The user may use the straw either subsequent to the spoon function, or in alternate use of the straw to the spoon by retracting in the straw into the handle. This is a benefit over the references described above, as the straw does not interfere with the spoon.

Commercially available straws are generally made of soft plastic, and may be cut to a desired length by common cutting utensils. While cutting the straw to a shorter length is not required, the present device makes use of this advantage.

The present device overcomes disadvantages of the prior art by (1) allowing the use of almost any commercially available straw which straw (2) is easily cut to proper length by the user, and which straw (3) is held in position by the hollow handle (4) to reach at a downward facing angle, (5) even in the deepest or narrowest of beverage or dessert containers.

Those skilled in the art will appreciate that a spoon and straw combination formed as the present device has the advantage that the functions of spooning and sucking are distinct. A user of the utensil may spoon a food product without the risk of the fluid portion inadvertently entering the straw and leaking out the aspiration end. The user of the utensil may also alternate use of the spoon with the straw without the straw interfering with the spoon.

The present device overcomes other disadvantages of earlier devices because the spoon may be formed of (1) flexible material for lightweight use, or (2) of inflexible material to both (a) scoop semi-solid foods, and (b) support those foods for delivery to the user. In either case, common injection molding techniques allow inexpensive, mass-quantity production of the device, which overcomes the cost factor of steel tubular straw and spoon combinations.

The present device also overcomes the disadvantages of earlier devices since the present device is reusable because the lumen is short enough to wash and rinse.

The present device also overcomes the detachable spoon disadvantage of these devices, as the spoon is integral with the handle. While the straw extension of the present device is removable, it is light and long, and is less susceptible to bury itself into the food should the user drop the straw.

Figure 7:
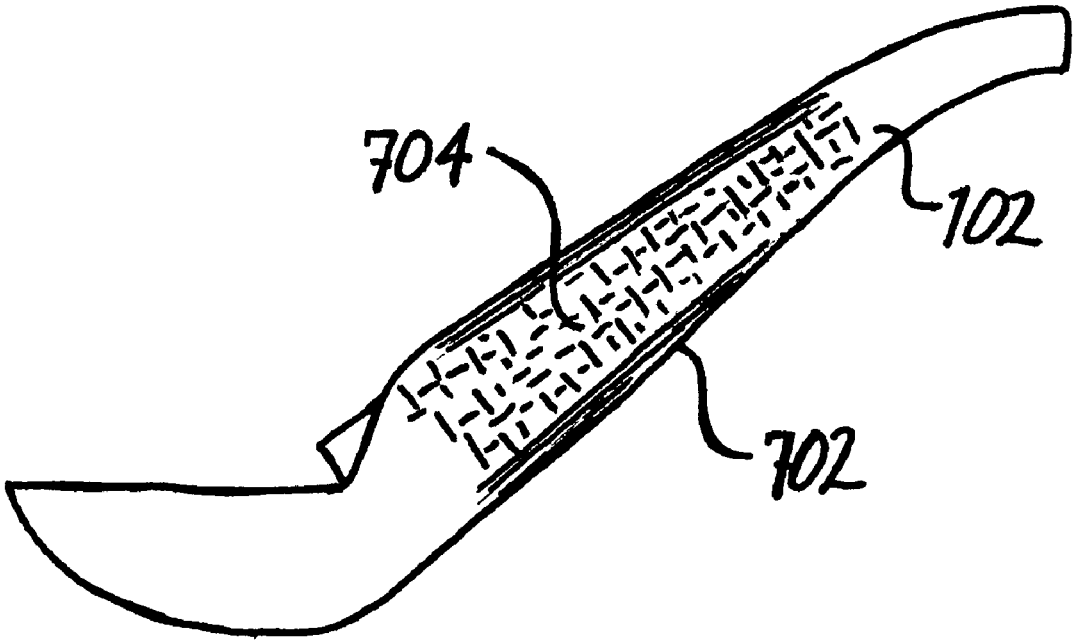
Figure 8:
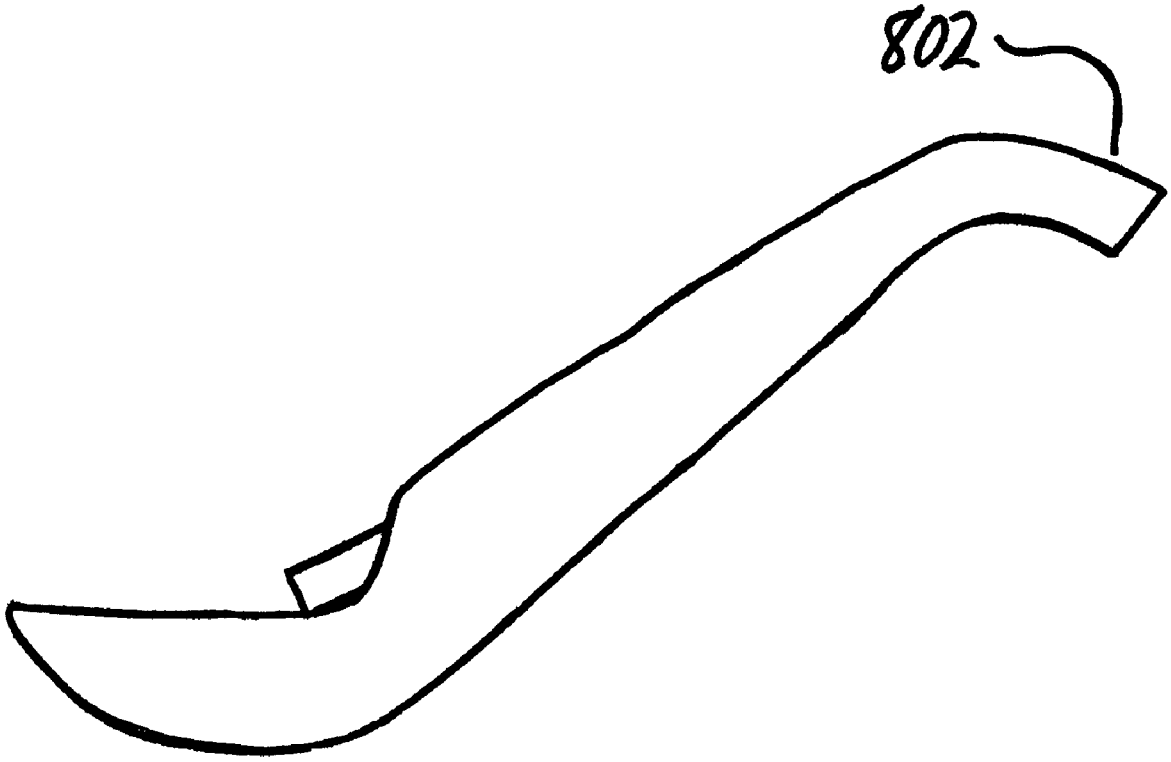
Figure 9:
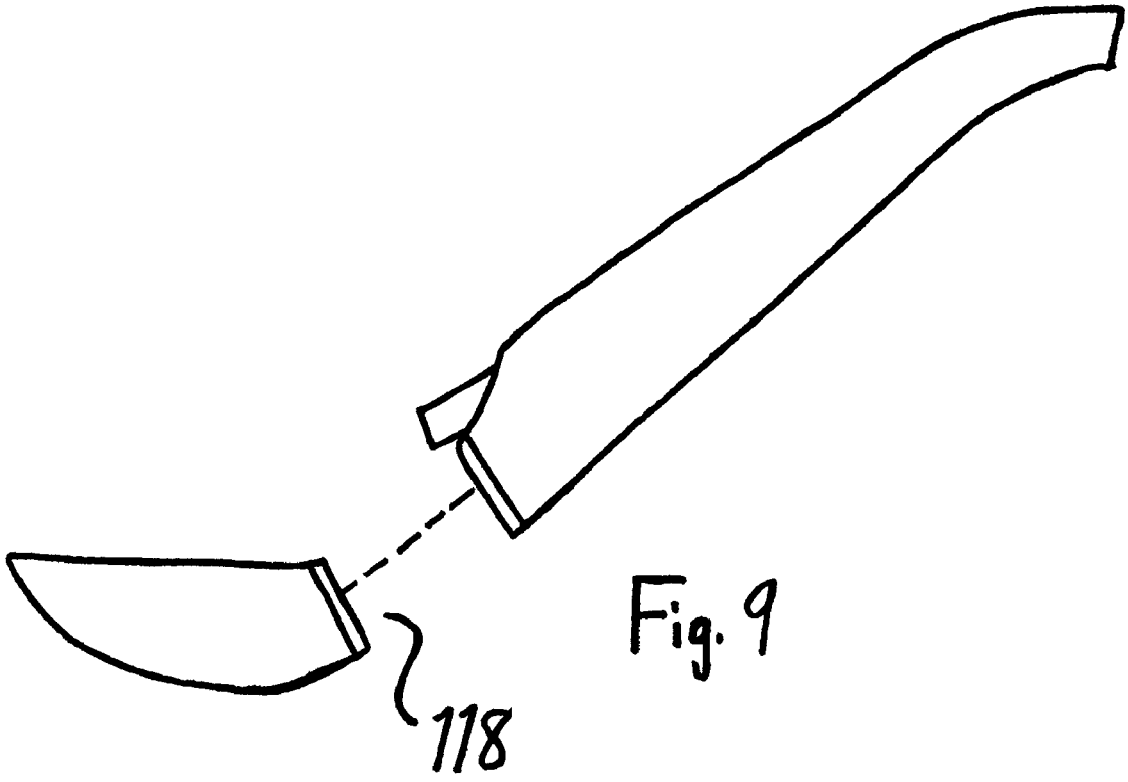
Figure 10:
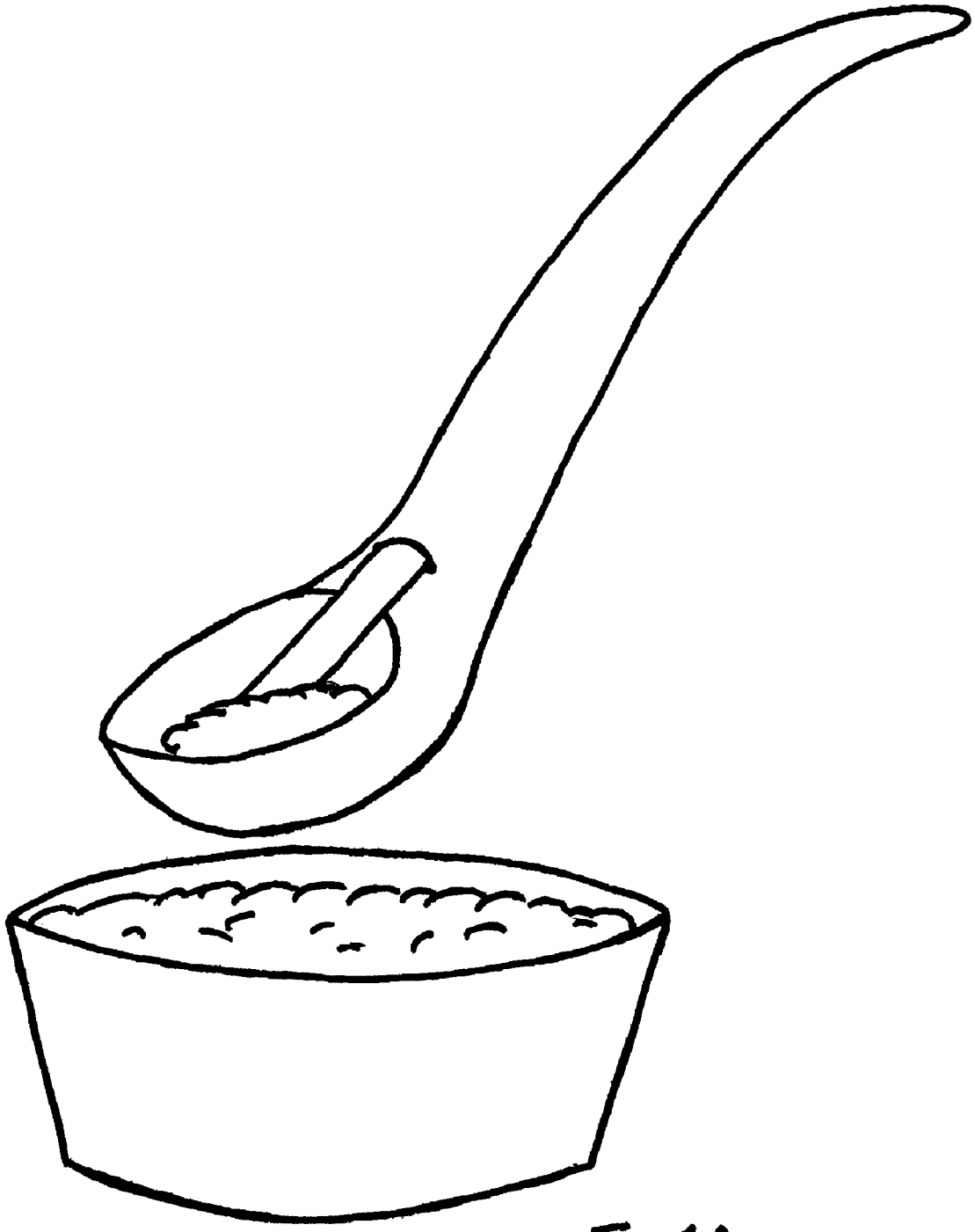
Figure 11:
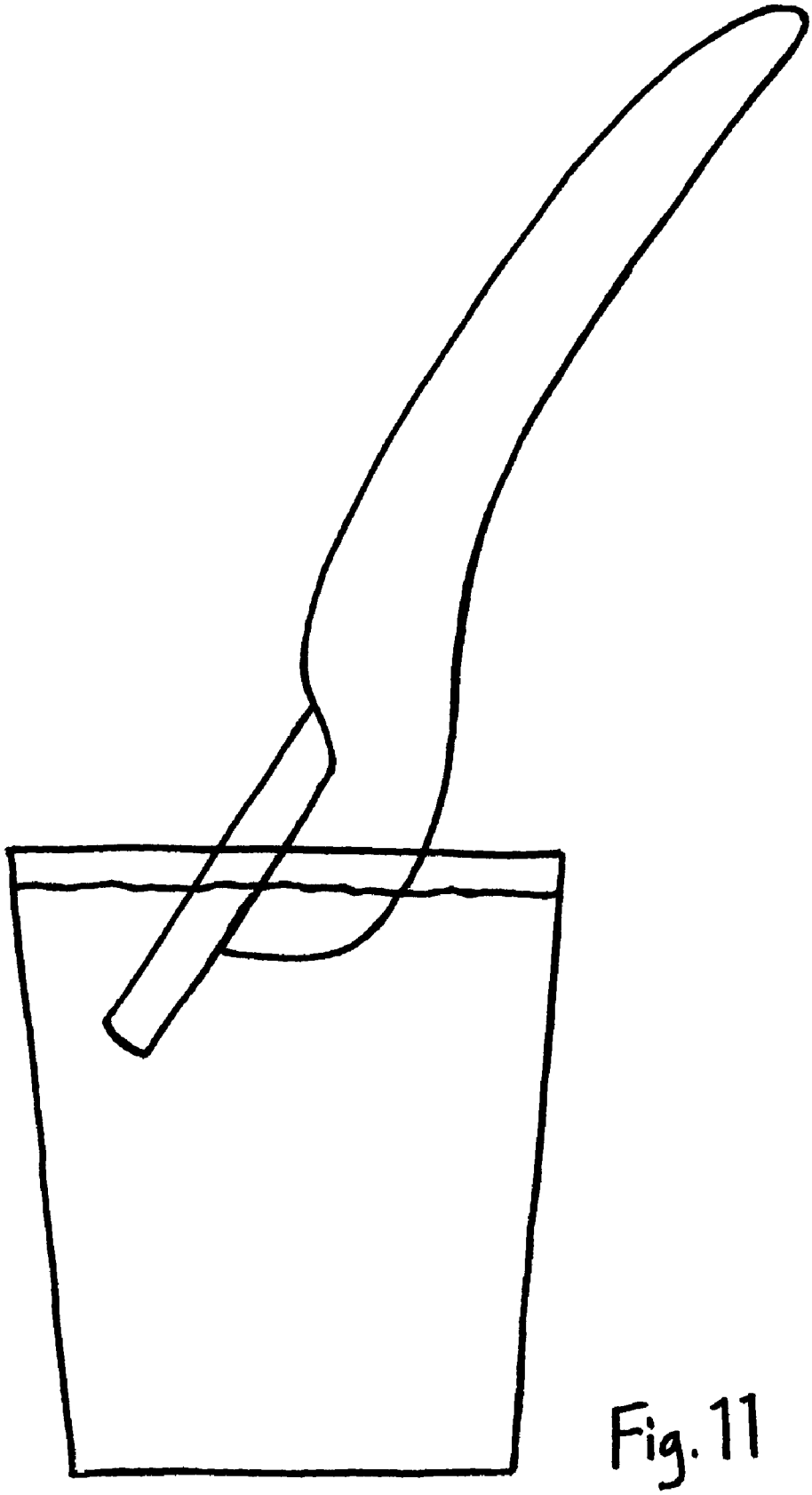

FIG. **6*a*** shows a cross-sectional view showing an alternative embodiment of the invention;

FIG. 7 shows a side view showing an alternative embodiment of the invention;

FIG. 8 shows a side view showing an alternative embodiment of the invention;

FIG. 9 shows a cross-sectional view showing an alternative embodiment of the invention;

FIG. 10 shows a view of a preferred embodiment of the present invention in communication with a typical comestible container;

FIG. 11 shows a view of a preferred embodiment of the present invention in communication with a typical comestible container.

DETAILED DESCRIPTION

Reference will now be made in detail to some embodiments of the invention, examples of which are illustrated in the accompanying drawings.

Figure 1:
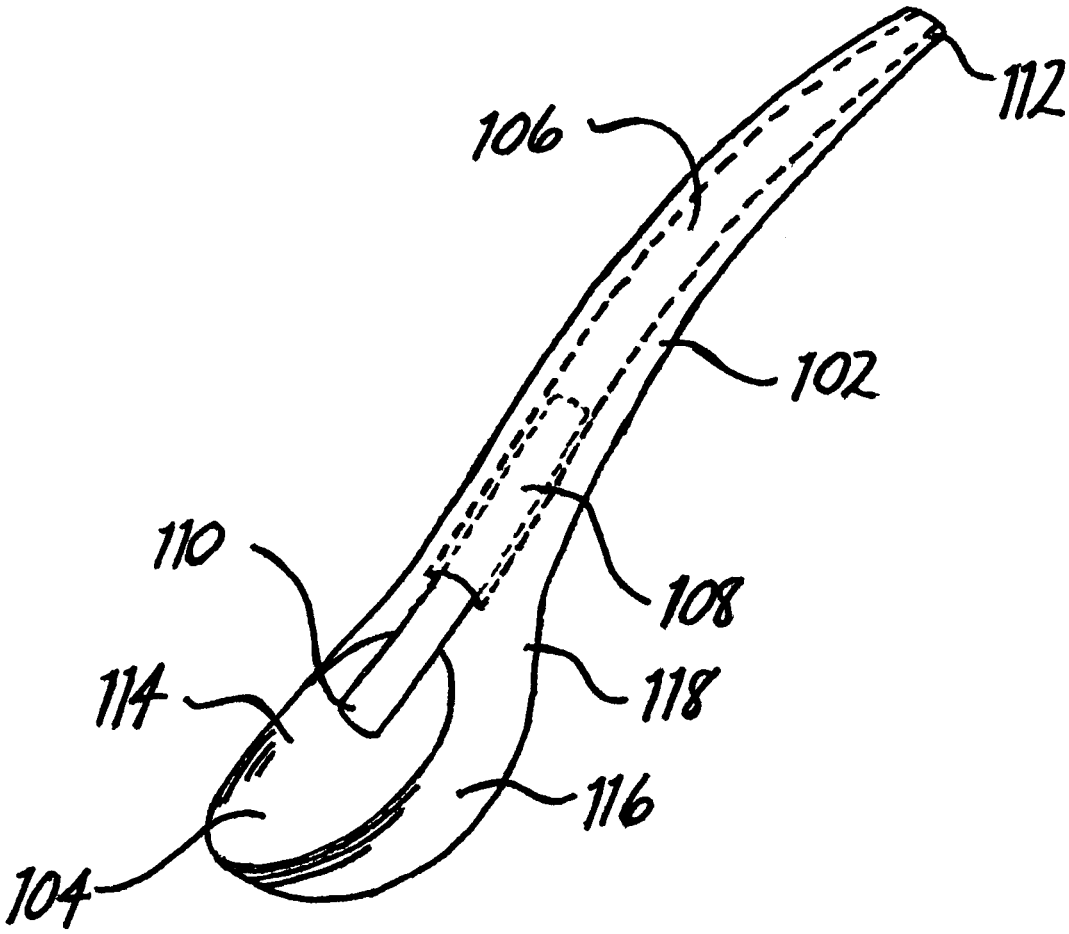
FIG. 1 shows a perspective view of the utensil formed in accordance with the present invention.

Referring to the drawings, FIG. 1 shows a perspective view of the utensil of the present invention with the straw extended into the spoon cavity. The utensil includes a hollow handle 102. Attached at the distal end of the hollow handle is a spoon cavity 104. Within the hollow 106 of the handle 102 is a flexible and extendable straw 108. The user extends the straw to place the suction end 110 of the straw in the foodstuff for aspiration. The user then draws on the opposing end 112 of the handle 102 to consume the foodstuff.

The spoon cavity 104 is formed from a continuous wall having a concave interior surface 114 and an exterior convex surface 116. The spoon cavity 104 is affixed to the hollow handle 102 by a junction 118. The junction 118 may take on several forms, as will be discussed in further detail, from simple bonding to a molded chamber. However, the junction 118 is always formed such that the suction end 110 of the straw is isolated from the interior surface 114 of the spoon cavity 104. This prevents inadvertent fluid flow from the spoon cavity 104 into the hollow handle 102, thereby providing for distinct functions of spooning and suction of the foodstuff.

Figure 2:
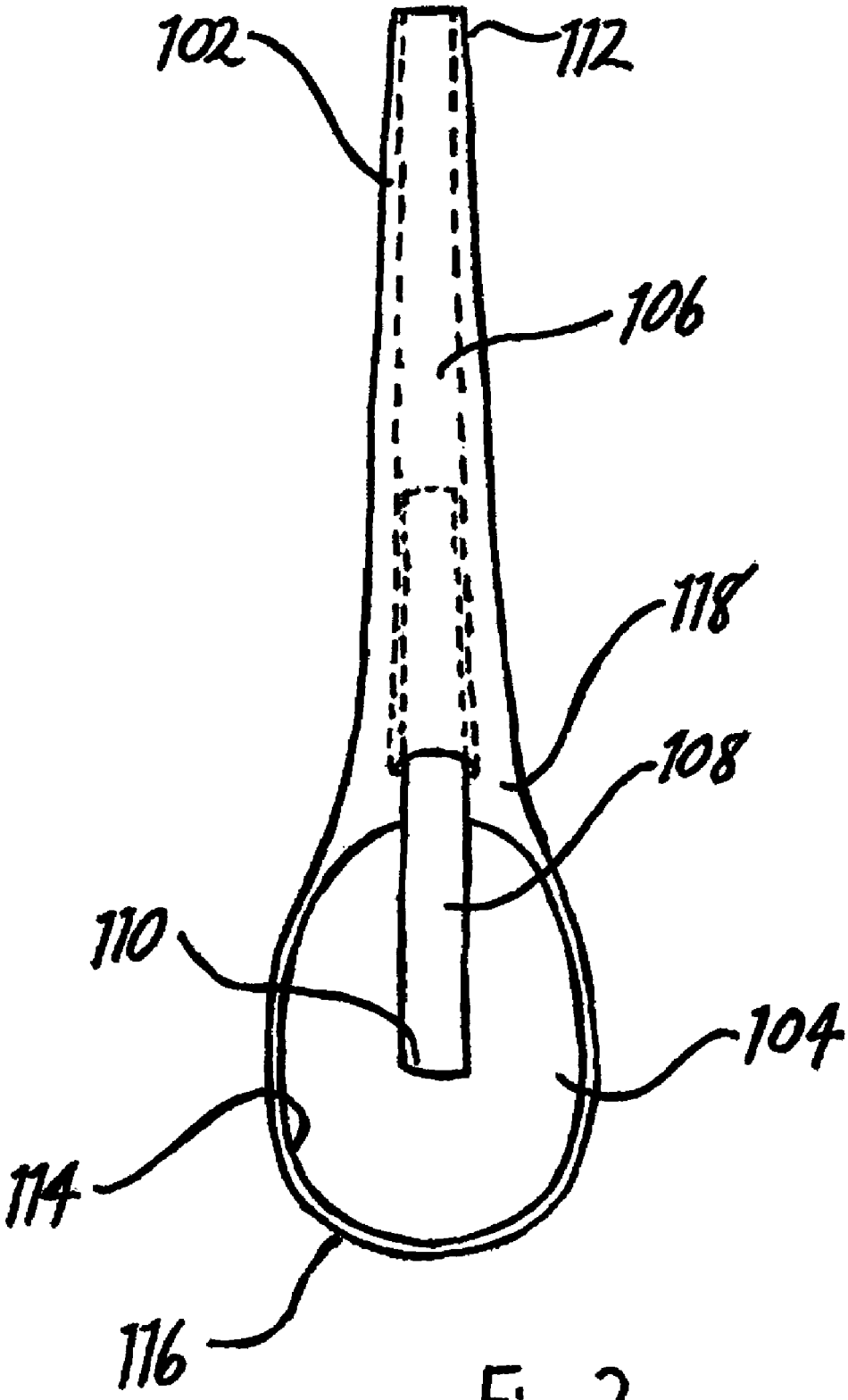
FIG. 2 shows a top plan view of a utensil formed in accordance with the present invention.

FIG. 2 shows a top plan view of a utensil formed in accordance with the present device, showing the straw extension 108 placed into the spoon cavity. In this position, the straw allows the user to suck up liquid or semi-liquid food from the spoon cavity.

Figure 3:
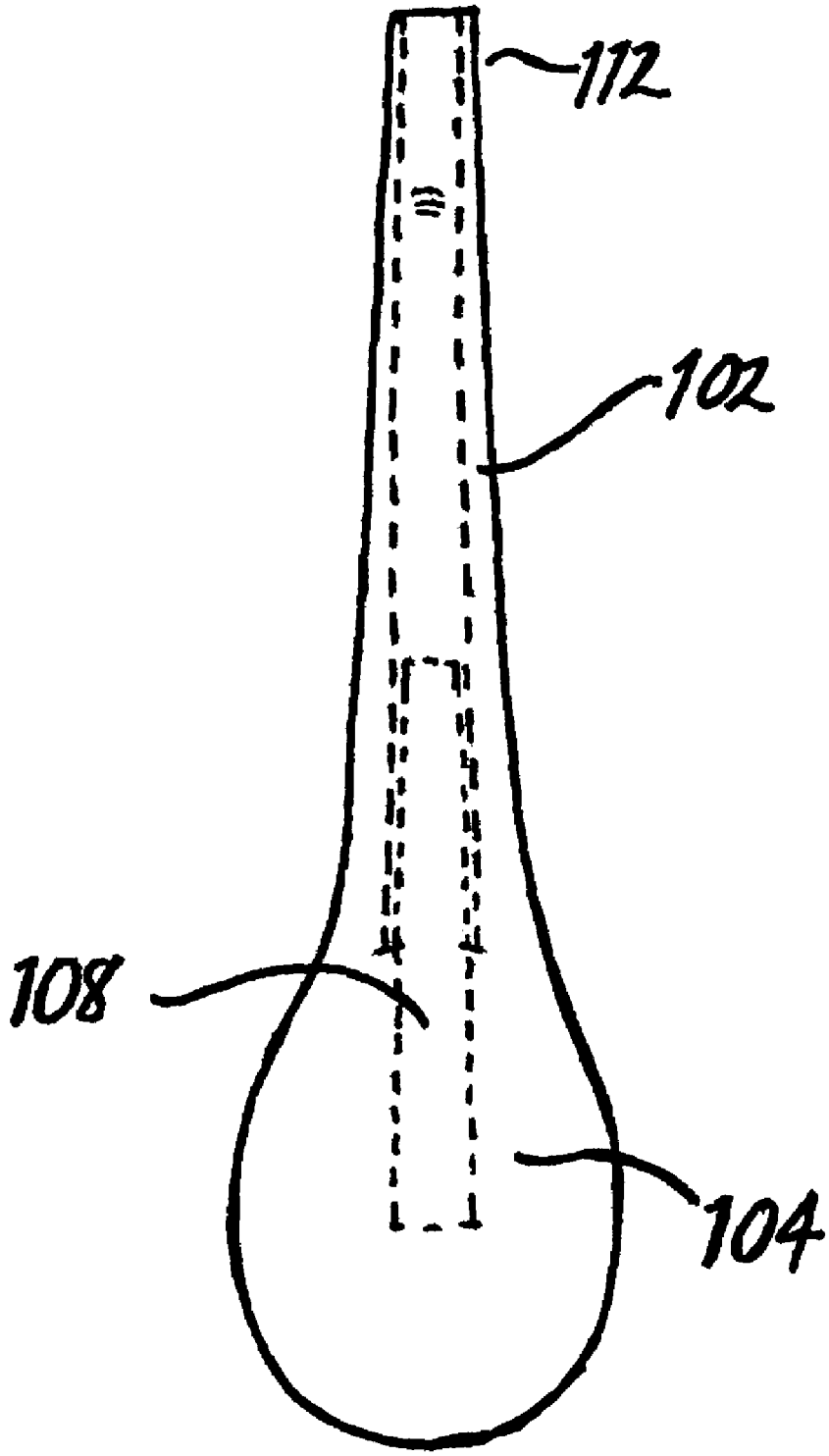
FIG. 3 shows a bottom plan view of a utensil formed in accordance with the present invention.

FIG. 3 shows a bottom plan view of a utensil formed in accordance with the present device, showing the straw extension 108 placed into the spoon cavity. In this position, the straw allows the user to suck up liquid or semi-liquid food from the spoon cavity.

Figure 4:
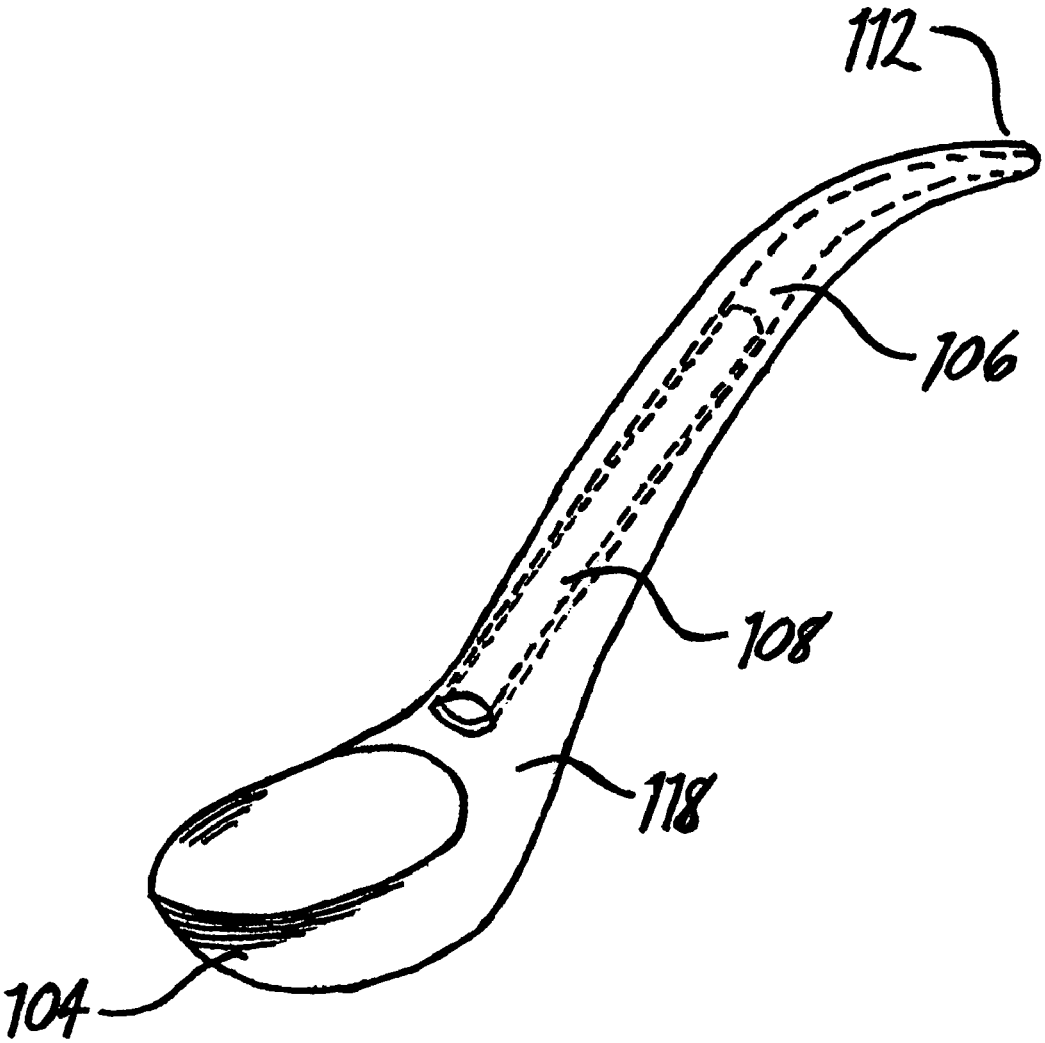
FIG. 4 shows a perspective view of a first embodiment of a utensil formed in accordance with the present invention.

FIG. 4 shows a perspective view showing the straw extension 108 drawn within the hollow handle 102 for use of the device as a spoon. In this position, the straw does not interfere with using the spoon cavity to scoop up foods.

Figure 5:
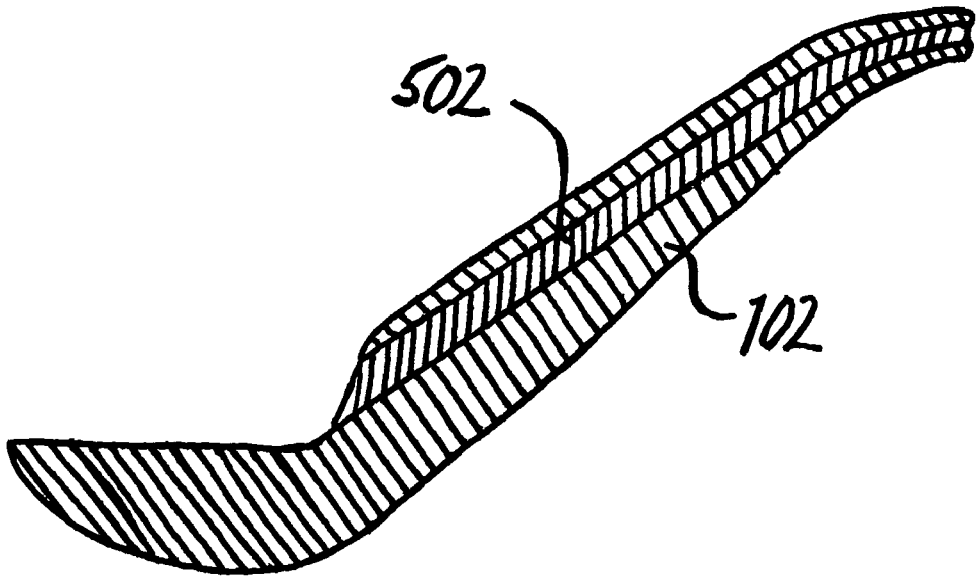
FIG. 5 shows a cross-sectional view of a first embodiment of the invention.

FIG. 5 shows a cross-sectional view showing an embodiment of the hollow handle 102 and narrowing of the interior 502 of the hollow handle 102 for holding different sizes of straws by friction with the interior handle walls.

Figure 6:
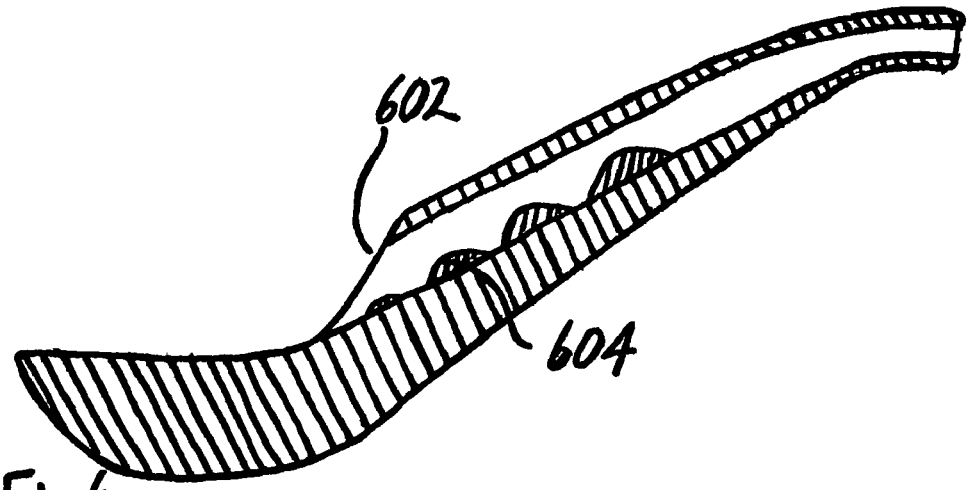
FIG. 6 shows a cross-sectional view showing an alternative embodiment of the invention.

FIG. 6 shows a cross-sectional view showing an alternative embodiment of the hollow handle 102 with a large lumen 602 for use with large diameter straws, and increasing gradients of interior detents 604 up the length of the lumen for holding different sizes of straws. The interior detents provide the geometric restriction for the straw.

Figure 6A:
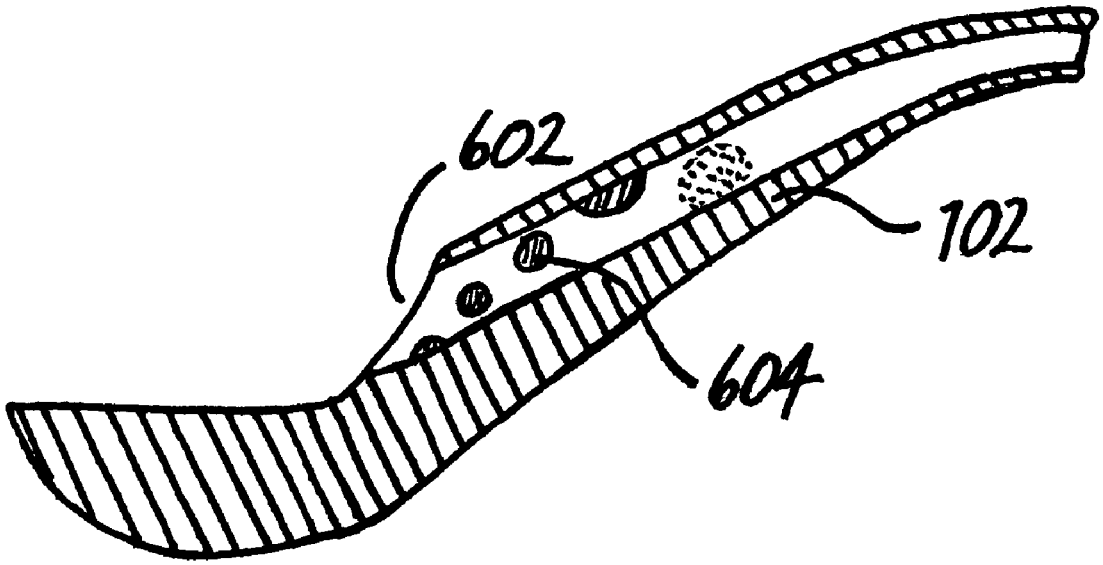

FIG. 6*a* shows a cross-sectional view showing an alternative embodiment of the hollow handle 102 with a large lumen 602 for use with large diameter straws, and increasing gradients of interior detents 604 up the length of the lumen for holding different sizes of straws. The interior detents are distributed radially along the straw to increase the contact area of the geometric restriction for the straw.

FIG. 7 shows a side view showing an alternative embodiment of the device with a round exterior 702 of the hollow handle 102 having a roughened surface 704 for holding of the device by persons with lessened dexterity.

FIG. 8 shows a side view showing an alternative embodiment of the device with the mouthpiece 802 at the aspiration end of the handle bent into a natural position for use by reclined persons.

FIG. 9 shows a cross-sectional view showing an alternative embodiment of the device showing the upwardly concave dish as changeable in the present device. Thus the user can exchange one style of spoon cavity (e.g., ice cream) for a different style of spoon cavity (e.g., soup). Here junction 118 serves to hold the spoon to the hollow handle. A small flexible clip molded in the wall of the junction may serve as the securing method of the junction. Other equivalent securing methods, such as rotating nubs, and friction-fit walls that are previously known and used in the art are suitable here.

FIG. 10 shows a view of a preferred embodiment of the present device in use with a typical foodstuff container and semi-liquid foodstuff.

FIG. 11 shows a view of a preferred embodiment of the present device in use with a typical foodstuff container and semi-liquid foodstuff.

FIGS. 1 and 2 also show that when the concave dish interior 104 faces upwardly, the elongated member 102 and the hollow portion 106 are on the same side of concave dish interior 104 as is the proximal edge of the concave dish 118 with respect to the exterior of the dish 116. This positioning allows the flexible tube to extend from the hollow portion above the concave dish without entering the concave dish, as shown in FIG. 7. This is advantageous over the prior art for two reasons. First, the straw may be used to consume foodstuff from the container without the spoon entering the foodstuff, similar to as shown in FIG. 8. Second, the spoon may be used to withdraw foodstuff from the container without the foodstuff spilling out the hollow portion, as is possible with the prior art.

What is claimed is:

1. A dining utensil, comprising:

an elongated member having a proximal end and a distal end;

said elongated member having a hollow portion with an open proximal end and an open distal end and an exterior surface;

said hollow portion running along the longitudinal midline of said elongated member;

said open proximal end of said hollow portion coinciding with said proximal end of said elongated member;

said hollow portion being capable of securing a flexible tube;

said flexible tube being retractable into said hollow portion, and extendable from within said hollow portion;

said elongated member having a mouthpiece at said proximal end;

a concave dish having a proximal edge and a distal edge wherein said proximal edge of said concave dish is joined to said distal end of said elongated member;

wherein when said concave dish faces upwardly, said hollow portion is above said concave dish; and said open distal end of said hollow portion is capable of interposing said flexible tube between said hollow portion and said proximal edge of said concave dish without said flexible tube entering said concave dish.

2. The dining utensil of claim 1, wherein said hollow portion of the elongated member decreases in cross-sectional area from said distal end of the elongated member towards said proximal end of said hollow portion.

3. The dining utensil of claim 1, wherein protrusions inside said hollow portion increase in size from said distal end of the elongated member towards said proximal end of said hollow portion.

4. The dining utensil of claim 1, wherein the exterior of said elongated member has a roughened surface.

5. The dining utensil of claim 1, wherein said mouthpiece of said elongated member lies at an acute angle in the vertical plane from said midline of said elongated member.

6. The dining utensil of claim 1, wherein said concave dish is detachable and secureably replaceable.

7. The dining utensil of claim 1, wherein said flexible tube may be extended into said concave dish so as to draw a liquid or semi-liquid substance through said flexible tube and through said hollow portion to said mouthpiece to deliver the liquid or semi-liquid substance to a user.

8. The dining utensil of claim 1, wherein said flexible tube may be extended beyond said distal edge of said concave dish, wherein the distal end of said flexible tube may be inserted into a liquid or semi-liquid, thereby establishing fluid communication between said liquid or semi-liquid and said flexible tube to permit drawing the fluid through said flexible tube and through said hollow portion to said mouthpiece to deliver the liquid or semi-liquid to a user.

* * * * *